US007467525B1

(12) United States Patent
Ohta et al.

(10) Patent No.: US 7,467,525 B1
(45) Date of Patent: Dec. 23, 2008

(54) SUPERCRITICAL REFRIGERATION CYCLE SYSTEM

(75) Inventors: Hiromi Ohta, Okazaki (JP); Yoshinori Murase, Nagoya (JP)

(73) Assignee: Denso Corporation, Kariya (JP)

( * ) Notice: Subject to any disclaimer, the term of this patent is extended or adjusted under 35 U.S.C. 154(b) by 154 days.

(21) Appl. No.: 11/507,833

(22) Filed: Aug. 22, 2006

(30) Foreign Application Priority Data

Aug. 23, 2005 (JP) ..... 2005-241654

(51) Int. Cl.
*F25B 1/00* (2006.01)

(52) U.S. Cl. ..... 62/498; 62/515

(58) Field of Classification Search ..... 62/498, 62/515, 196.3
See application file for complete search history.

(56) References Cited

U.S. PATENT DOCUMENTS

| | | | |
|---|---|---|---|
| 6,092,379 | A | 7/2000 | Nishida et al. |
| 2006/0137388 | A1 | 6/2006 | Kakehashi |

FOREIGN PATENT DOCUMENTS

| | | |
|---|---|---|
| EP | 1 519 123 | 3/2005 |
| JP | 2000-35250 | 2/2000 |
| JP | 2005-106318 | 4/2005 |

*Primary Examiner*—Melvin Jones
(74) *Attorney, Agent, or Firm*—Harness, Dickey & Pierce, PLC

(57) ABSTRACT

A supercritical refrigeration cycle system (10) having a simplified flow path configuration comprises a compressor (1) for sucking in and compressing a refrigerant, a radiator (2) for radiating the heat of the high-pressure refrigerant discharged from the compressor (1), a high-pressure control valve (5) and a superheat control valve (12) into which the high-pressure refrigerant flowing out of the radiator (2) flows after being distributed, a first evaporator (6) for evaporating the influent refrigerant decompressed by the high-pressure control valve (5), and a second evaporator (9) for evaporating the influent refrigerant decompressed by the superheat control valve (12). The outlet of the second evaporator (9) and the inlet of the first evaporator (6) are connected to each other by the refrigerant path (13) in such a manner that the refrigerant flowing out of the second evaporator (9) flows into the first evaporator (6). An increase in the blowout air temperature can be reduced by controlling the refrigerant flowing in each of the plurality of the evaporators.

9 Claims, 11 Drawing Sheets

SUPERCRITICAL REFRIGERATION CYCLE SYSTEM

BACKGROUND OF THE INVENTION

1. Field of the Invention

This invention relates to a supercritical refrigeration cycle system of a vapor-compression-type comprising a plurality of evaporators in which the refrigeration pressure on high pressure side increases to at least the critical pressure.

2. Description of the Related Art

A conventional refrigeration cycle system of this type is known to include a compressor for compressing a refrigerant, a radiator for cooling the refrigerant discharged from the compressor, a first decompressor and a second decompressor for reducing the pressure of the refrigerant flowing out of the radiator, a first evaporator for evaporating the refrigerant flowing out of the first decompressor, a second evaporator for evaporating the refrigerant flowing out of the second decompressor, and a solenoid valve for controlling the refrigerant flow from the radiator into the second decompressor, wherein the air blown into the front part of the compartment is cooled by the first evaporator and the air blown into the rear part of the compartments is cooled by the second evaporator (Japanese Unexamined Patent Publication No. 2000-35250 (Patent Document 1)).

As a measure for suppressing the production cost, on the other hand, a system in which the number of expansion valves for decompressing the refrigerant is reduced and the decompressed refrigerant is distributed to each evaporator has been proposed (Japanese Unexamined Patent Publication No. 2005-106318 (Patent Document 2)).

In the refrigeration cycle system described in Patent Document 1, however, if the low pressure of the refrigerant is reduced during the transient period of starting or increasing the rotational speed of the compressor, and because a temperature-type expansion valve is used as a second decompressor, the drop in the low pressure immediately acts to open the second decompressor as shown in the example of the behavior of starting the system using a mechanical expansion valve (see FIGS. 11A, 11B). Further, the temperature drop at the evaporator outlet is accompanied by the delay due to heat transmission and, therefore, the valve opening degree of the second decompressor is excessively increased temporarily, with the result that the refrigerant flow rate is not properly distributed to each evaporator, thereby posing the problem that the blowout air temperature, of the evaporator short in the refrigerant flow rate, increases.

In the case where an electrical expansion valve is used as a second decompressor, on the other hand, the low pressure has no effect. Even in the case where the low pressure drops during the transient period, therefore, the valve opening degree is not excessively increased. Although the detection of a superheat amount requires the detection of the refrigerant temperature at the outlet of the evaporator, an excessively fast response destabilizes the operation of the electrical expansion valve and leads to the problem of hunting, etc. To secure stability, the response to temperature detection is required to be somewhat slow. In the case where the thermal load or the rotational speed of the compressor undergo an abrupt change, therefore, the refrigerant flows excessively, temporarily, and the resultant increased superheat amount of the first evaporator may increase the blowout air temperature.

In the refrigeration cycle system described in Patent Document 2, on the other hand, the high-pressure refrigerant, after being decompressed in the expansion valve, is required to be sent to each evaporator by piping. In the automotive air conditioning system, for example, the refrigerant is sent to the front evaporator in the dashboard for the front seats on the one hand and must send the low-pressure low-temperature refrigerant to the rear evaporator for the rear seats through a long pipe. To suppress the heat loss in the long pipe and the frosting of the pipe, the pipe is required to be covered by a heat insulating material.

SUMMARY OF THE INVENTION

This invention has been developed to solve the problems described above and the object thereof is to provide a supercritical refrigeration cycle system having a simple flow path structure in which the refrigerants flowing in a plurality of evaporators are appropriately controlled to suppress the increase in the blowout air temperature.

In order to achieve the object described above, this invention employs the technical means described below. Specifically, the supercritical refrigeration cycle system of vapor compression type according to the invention, in which the high pressure in the refrigeration cycle reaches a value not lower than the critical pressure of the refrigerant, comprises a compressor (1) for sucking in and compressing the refrigerant, a radiator (2) for radiating the heat of the high-pressure refrigerant discharged from the compressor (1), a plurality of decompressors (5, 12) into which the high-pressure refrigerant flowing out from the radiator (2) is distribute and flows, a first evaporator (6) for evaporating the refrigerant decompressed by the first decompressor (5), and a second evaporator (9) for evaporating the refrigerant decompressed by the second decompressor (12), wherein the refrigerant flowing out of one of the first evaporator (6) and the second evaporator (9) flows into the other evaporator.

According to a first aspect of the invention, there is provided a supercritical refrigeration cycle system, wherein the high-pressure refrigerant is distributed and then decompressed, and the refrigerant flowing out of one of the first evaporator (6) and the second evaporator (9) is rendered to flow into the other evaporator, so that the refrigerant flowing through each evaporator can be properly controlled with a simple refrigerant path configuration. Especially, a stable air-conditioning air can be supplied by reducing the difference of the blowout air temperatures between the evaporators.

According to a second aspect of the invention, there is provided a supercritical refrigeration cycle system, wherein one of the plurality of the decompressors constitutes a high-pressure control valve (5) for maintaining a high pressure maximizing the coefficient of performance of the refrigeration cycle.

In the second aspect of the invention, one of the plurality of the decompressors constitutes the high-pressure control valve (5) and the operation efficiency of the refrigeration cycle is improved.

According to a third aspect of the invention, there is provided a supercritical refrigeration cycle system, wherein the refrigerant flowing out of the second evaporator (9) flows into the first evaporator (6), and the second decompressor constitutes a mechanical superheat control valve (12) for controlling the superheat amount of the refrigerant at the outlet of the second evaporator (9).

In the third aspect of the invention, the control circuit for controlling the superheat amount is eliminated and the cycle configuration is simplified.

According to a fourth aspect of the invention, there is provided a supercritical refrigeration cycle system, wherein the refrigerant flowing out of the second evaporator (9) flows into the first evaporator (6), and the second decompressor constitutes a fixed diaphragm unit (14) or a differential pressure valve with the opening area thereof variable by the pressure before and after the diaphragm mechanism.

In the fourth aspect of the invention, the trouble of hunting is not caused in the high pressure control which otherwise might be caused by the superheat control of the refrigerant at the outlet of the evaporator, thereby improving the operation efficiency of the refrigeration cycle.

According to a fifth aspect of the invention, there is provided a supercritical refrigeration cycle system, wherein the refrigerant flowing out of the second evaporator (9) flows into the first evaporator (6) and the second decompressor makes up an electrical expansion valve (19).

In the fifth aspect of the invention, the fact that the second decompressor constitutes the electrical expansion valve (19) makes it possible to switch on/off the refrigerant flowing into the second evaporator (9) with the electrical expansion valve alone without using any on/off solenoid valve.

According to a sixth aspect of the invention, there is provided a supercritical refrigeration cycle system, wherein the opening degree of the electrical expansion valve (19) is controlled based on the temperature information of the refrigerant before and after the second evaporator (9).

In the sixth aspect of the invention, the refrigerant flow can be controlled with a fast response.

According to a seventh aspect of the invention, there is provided a supercritical refrigeration cycle system of vapor compression type wherein the high pressure in the refrigeration cycle reaches a level not lower than the critical pressure of the refrigerant, comprising a compressor (1) for sucking in and compressing a refrigerant, a radiator (2) for radiating the heat of the high-pressure refrigerant discharged from the compressor (1), a plurality of refrigerant paths for distributing the high-pressure refrigerant flowing out of the radiator (2), a first evaporator (6) and a second evaporator (9) for evaporating the distributed high-pressure refrigerants, respectively, and an accumulator (34) for separating the inflowing refrigerant into a gas-phase refrigerant and a liquid-phase refrigerant and supplying the gas-phase refrigerant to the compressor (1), wherein the plurality of the refrigerant paths include at least a bypass (28) through which the distributed high-pressure refrigerant is decompressed and flows into the accumulator (34), a first distribution path (29) and a second distribution path (31) for distributing the high-pressure refrigerant to the first evaporator (6) and the second evaporator (9), respectively, the system further comprising a superheat control valve (25, 27) for controlling the superheat amount of at least one of the refrigerant at the outlet of the first evaporator (6) and the refrigerant at the outlet of the second evaporator (9).

In the seventh aspect of the invention, the system comprises the bypass (28) for decompressing the high-pressure refrigerant in addition to the first distribution path (29) and the second distribution path (31) for distributing the high-pressure refrigerant into the first evaporator (6) and the second evaporator (9), and, therefore, the refrigerant flowing in each evaporator can be appropriately controlled and an increase in the blowout air temperature can be suppressed with a simple configuration of the refrigerant paths.

According to an eighth aspect of the invention, there is provided a supercritical refrigeration cycle system, wherein the bypass (28) includes a high-pressure control valve (23, 33) for maintaining a high pressure maximizing the coefficient of performance of the refrigeration cycle.

In the eighth aspect of the invention, the operation efficiency of the refrigeration cycle can be improved.

According to a ninth aspect of the invention, there is provided a supercritical refrigeration cycle system, wherein the bypass (28) includes a fixed diaphragm mechanism (32) or a differential pressure valve having an opening area changeable by the pressure before and after the diaphragm mechanism.

In the ninth aspect of the invention, the trouble of hunting is not caused in the high-pressure control which otherwise might be caused by the superheat control of the refrigerant at the outlet of the evaporator thereby improving the operation efficiency of the refrigeration cycle.

The reference numerals in the parentheses attached to the respective means indicate the correspondence with the specific means of the embodiments described later.

The present invention may be more fully understood from the description of preferred embodiments of the invention, as set forth below, together with the accompanying drawings.

DESCRIPTION OF THE PREFERRED EMBODIMENTS

First Embodiment

Figure 1:
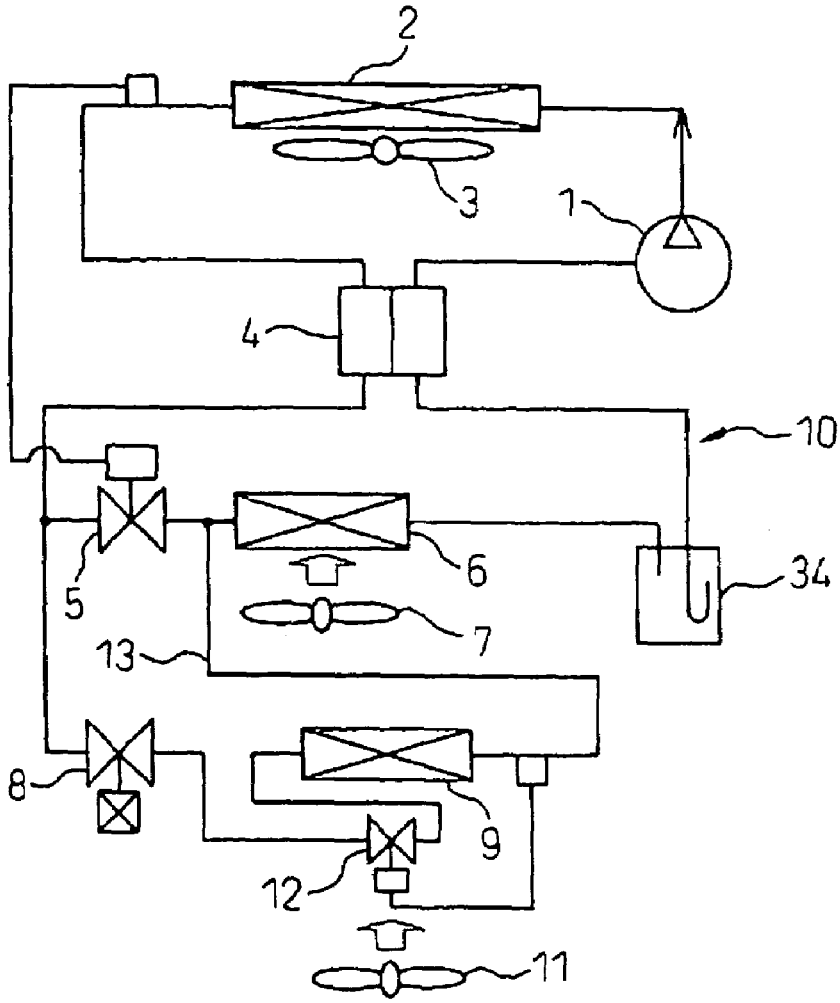
FIG. 1 is a schematic diagram showing a configuration of a refrigeration cycle system according to a first embodiment of the invention.

A first embodiment of the invention is explained below with reference to FIG. 1. The supercritical refrigeration cycle system according to this embodiment is of vapor compression type and includes a plurality of evaporators. A dual-type air conditioning system used for automobiles or the like is described as an example. Also, carbon dioxide is used as a refrigerant for the supercritical refrigeration cycle system.

A refrigeration cycle system 10 according to this embodiment includes a compressor 1 for sucking in and supplying a refrigerant under pressure, a radiator 2 corresponding to a high-pressure heat exchanger for radiating the heat of the high-pressure refrigerant discharged from the compressor 1, a first decompressor and a second decompressor into which the high-pressure refrigerant flowing out of the radiator 2 is distributed and flows, a first evaporator 6 for evaporating the influent refrigerant decompressed by a high-pressure control valve 5 corresponding to the first decompressor, and a second evaporator 9 for evaporating the inflowing refrigerant decompressed by a mechanical superheat control valve 12 corresponding to the second decompressor. The refrigeration cycle system 10 further comprises an internal heat exchanger 4 for exchanging heat between a high-pressure refrigerant and a low-pressure refrigerant and a solenoid valve 8 connected in series to the superheat control valve 12 upstream of the second evaporator 9 for controlling the refrigerant flowing into the second evaporator 9.

The outlet of the second evaporator 9 and the inlet of the first evaporator 6 are connected to each other by a refrigerant path 13 arranged so that the refrigerant flowing out of the second evaporator 9 flows into the first evaporator 6. The refrigerant flowing out of the first evaporator 6 is separated into a liquid-phase refrigerant and a gas-phase refrigerant by an accumulator 34 for storing the extraneous refrigerant in the refrigeration cycle. The gas-phase refrigerant constituting a low-pressure refrigerant exchanges heat with the high-pressure refrigerant in the internal heat exchanger 4 and flows to the inlet of the compressor 1.

The compressor 1 is a variable replacement refrigerant compressor so configured that the discharge capacity thereof is electrically controlled by an ECU 80 to control the cooling capacity. The information on the rotational speed of the compressor 1 is sent to the ECU 80. The compressor 1 may alternatively be configured of a clutch controlled by a clutch control output signal from the ECU 80.

In the radiator 2, heat is exchanged between the high-pressure, high-temperature refrigerant discharged from the compressor 1 and the air blown by a fan or the air flow generated by the running vehicle, so that the refrigerant pressure in the radiator 2 exceeds the critical pressure. The radiator 2 is cooled by an electrically-operated cooling fan 3. The cooling fan 3 may be directly connected to an engine as a coupling fan or driven by a hydraulic motor. Also, the cooling fan 3 may double as a radiator cooling fan or may be used only for the radiator 2. Further, the cooling fan 3 may be mounted integrally with the radiator 2 or fixed on a vehicle parts.

Figure 4:
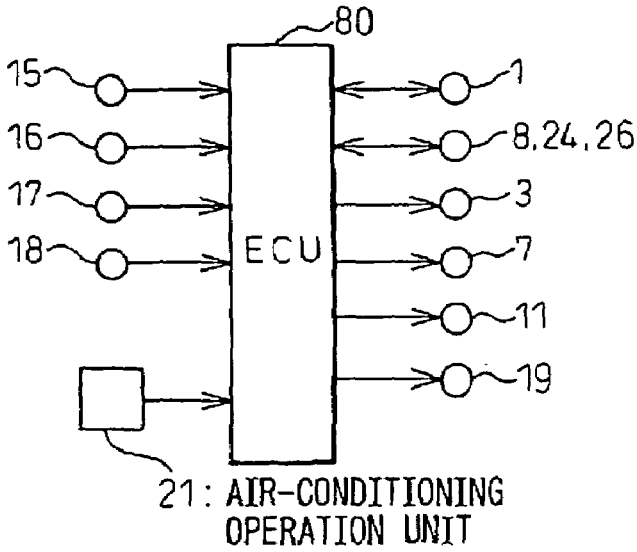
FIG. 4 is a block diagram showing the relation between the component parts and the control means of the refrigeration cycle system according to the first, second, third, fourth, fifth, sixth and seventh embodiments.

The first evaporator 6 is a heat exchanger for absorbing heat from the atmospheric air and evaporating the liquid refrigerant reduced in pressure by the high-pressure control valve 5. The air passed through the heat transmission of the first evaporator 6 by the air blown from the blower 7 controlled by the ECU 80 shown in FIG. 4 is deprived of heat, and after being cooled while at the same time being dehumidified, sent from the front of the compartments toward the occupants in the front seats as a cool air.

The temperature sensing cylinder portion of the high-pressure control valve 5 detects the temperature of the refrigerant at the outlet of the radiator 2, and maintains a high pressure maximizing the COP (coefficient of performance) of the refrigeration cycle. Also, the high-pressure control valve 5 may be an electrical expansion valve electrically controlled by the ECU 80 instead of the mechanical one described above.

The superheat control valve 12 is an expansion valve for detecting the refrigerant temperature at the outlet of the second evaporator 9 and the refrigerant pressure in the second evaporator 9 to thereby control the superheat amount at the outlet of the second evaporator 9. The superheat control valve 12 is arranged in parallel to the high-pressure control valve 5 in the refrigeration cycle, and is located at a position exposed to the air blown by the blower 1 upstream of the second evaporator 9 in the air flow. This arrangement makes it possible to detect the temperature of the temperature detecting tube, which detects superheat at an outlet of evaporator and to be responsive accurately, since the decompressed low-temperature refrigerant is less influential in changing pressure of the gas sealed in the diaphragm. The superheat control valve 12 may be of either a built-in type for sensing the temperature through a built-in working rod or a temperature sensing cylinder type in which the temperature is sensed through a temperature sensing cylinder by capillary communication of the refrigerant sealed on the diaphragm.

The second evaporator 9 is a heat exchanger for absorbing heat from the atmospheric air and evaporating the liquid refrigerant reduced in pressure by the superheat control valve 12. The air passed through the heat transmission of the second evaporator 9 by the air blown from the blower 11 under the control of the ECU 80 shown in FIG. 4, after being deprived of heat cooled while at the same time being dehumidified, is sent from the rear part of the compartments toward the occupants in the rear seats as cool air.

The solenoid valve 8, under the control of the ECU 80, can be switched either to stop the inflow of the refrigerant from the radiator 2 into the second evaporator 9 or to allow the refrigerant to flow into the second evaporator 9. The solenoid valve 8 has the function of switching on/off a cooling operation of the second evaporator 9 such as the operation of cooling the rear part of the compartments. By the switching operation of the air-conditioning operation unit 21 by the user, the solenoid valve 8 opens and the refrigerant flows into the second evaporator 9 when the rear air-conditioning mode is on, while the solenoid valve 8 is closed and the refrigerant flow to the second evaporator 9 is blocked when the rear air-conditioning mode is off.

Instead of the two evaporators employed in this embodiment, the refrigeration cycle system 10 according to the invention may employ three or more evaporators. The system having three evaporators, for example, may be configured of a high-pressure control valve for controlling the flow rate of the refrigerant flowing in one of the evaporators and a superheat control valve for controlling the flow rate of the refrigerant flowing in the remaining two evaporators.

Next, the refrigerant state in the refrigeration cycle due to the operation of the refrigeration cycle system 10 is explained. First, in steady system operation, the proportion of flow rate of the refrigerant in the first evaporator 6 and the second evaporator 9 is adjusted in the manner described below. The superheat control valve 12 controls the flow rate of the refrigerant in the second evaporator 9 in such a manner that the superheat amount at the outlet of the second evaporator 9 assumes a set value, and the refrigerant with the superheat amount thus controlled is mixed with the liquid refrigerant reduced in pressure by the high-pressure control valve 5 and flows into the first evaporator 6 through the refrigerant path 13. The saturated gas refrigerant produced by evaporation of the liquid refrigerant by heat exchange with the air blown into the compartments and the saturated gas refrigerant produced by mixing and heat exchange between the superheat gas refrigerant flowing in from the second evaporator 9 and the liquid refrigerant are sent to the accumulator 34 from the first evaporator 9. In the accumulator 34, only the saturated gas is sucked into the compressor 1 through the internal heat exchanger 4 from the accumulator 34. As a result, the enthalpy of evaporation of the influent liquid refrigerant is balanced to an amount equal to the sum of the enthalpy for cooling the superheat gas from the second evaporator 9 by the saturated gas and the enthalpy of the heat exchanged by the first evaporator with the air blown into the compartments. Thus, a predetermined low-pressure state is maintained.

In the refrigeration cycle system 10, the refrigerant flowing out of the second evaporator 9 flows into the first evaporator 6 again. Even in the case where the provisional drop in pressure excessively increases the opening degree of the superheat control valve 12 and the refrigerant flowing in the second evaporator 9 becomes excessive in amount at the time of starting or accelerating the vehicle, therefore, the refrigerant flow rate in the first evaporator 6 does not run short, so that the temperature of the blown air passing through the evaporator is not inconveniently increased.

Also, the superheat control valve 12 functions as an expansion valve for decompressing the high-pressure refrigerant. By arranging the superheat control valve 12 in the vicinity of the second evaporator 9, therefore, the low-pressure pipe upstream of the second evaporator 9 can be shortened, thereby making it possible to reduce the heat loss midway through the pipe. At the same time, the long high-pressure pipe and the short low-temperature low-pressure pipe of the refrigeration cycle can reduce the heat loss and the consumption of the heat insulating material for preventing the frosting of the pipes. In the case where the evaporator is arranged in the rear seat of the vehicle, for example, the heat insulating material or the like would be required to be attached on the long pipe leading to the evaporator. Such a heat insulating material is eliminated in the refrigeration cycle system 10 according to this embodiment.

The high-pressure pipe is also arranged on the upstream side of the solenoid valve 8, and therefore the high-pressure refrigerant exists in the pipe also in the off state of the second evaporator 9. Thus, the variation of the refrigerant amount caused by the on/off operation of the second evaporator 9 is also reduced. In the configuration of the conventional refrigeration cycle system described in Patent Document 2, no liquid refrigerant exists in the pipe leading to the second evaporator as long as the refrigerant to the second evaporator 9 is cut off by a solenoid valve or the like. As long as the solenoid valve is open, on the other hand, both the gas-phase refrigerant and the liquid-phase refrigerant flow in the pipe. Thus, a great difference in the flow rate in the pipe develops according to whether the solenoid valve is open or closed, resulting in a need for a bulky accumulator for storing the extraneous refrigerant while the valve is closed. In the refrigeration cycle system 10 according to this embodiment, however, such a large accumulator is not required.

Also, both the first evaporator 6 and the second evaporator 9 are connected to an expansion valve for decompressing the high-pressure refrigerant. In spite of the pressure loss of one of the paths, therefore, the refrigerant can be supplied at an arbitrary proportion of flow rate by adjusting the opening degree of the expansion valve, and the pressure loss of the first evaporator 6 and the second evaporator 9 can be adjusted. Thus, the addition of extraneous parts or a complicated valve for adjusting the flow rate distribution is not required.

In a configuration of refrigeration cycle with the first and second evaporators connected in series to each other and the refrigerant distributed to each evaporator after decompression, the opening area of the path leading to each evaporator is required to be adjusted. Thus, a switching valve complicated in structure is required or in order to supply any of the evaporators at a greater flow rate, a flow resistance must be added. In the refrigeration cycle system 10 according to this embodiment, however, the flow rate of the refrigerant can be controlled appropriately without such a complicated configuration.

As described above, the refrigeration cycle system according to this embodiment includes a compressor 1, a radiator 2 for radiating the heat of a high-pressure refrigerant discharged from the compressor 1, a plurality of decompressors into which the high-pressure refrigerant flows from the radiator 2 after distribution, a first evaporator 6 for evaporating the refrigerant decompressed by one of the decompressors constituting the high-pressure control valve 5 and a second evaporator 9 for evaporating the refrigerant decompressed by the superheat control valve 12, wherein the refrigerant flowing out of the second evaporator 9 flows into the first evaporator 6. This configuration makes it possible to control appropriately the refrigerant flowing in each evaporator with a simple refrigerant path configuration. Especially, a refrigeration cycle system is obtained in which the difference in blowout air temperature between the evaporators is reduced and a stable air-conditioning air can be supplied. Also, the use of one of the plurality of the decompressors as the high-pressure control valve 5 can improve the operation efficiency of the refrigeration cycle.

Also, the refrigerant flowing out of the second evaporator 9 flows into the first evaporator 6, and the superheat amount of the refrigerant at the outlet of the second evaporator 9 is controlled by a mechanical superheat control valve 12. By employing this configuration, the control circuit for controlling the superheat amount is eliminated and the cycle configuration simplified.

Second Embodiment

A second embodiment of the invention is explained with reference to FIG. 2. A refrigeration cycle system 20 according to this embodiment is different from the refrigeration cycle system 10 according to the first embodiment in that the second embodiment employs a fixed diaphragm unit 14, such as an orifice, as a second decompressor constituting a diaphragm means. The diaphragm means may be configured of a differential pressure valve with the opening area thereof variable by the pressure before and after the diaphragm mechanism.

In the case where the adjustment range of the refrigerant flow rate is narrow for the superheat control valve according to the first embodiment and the second evaporator 9 is smaller in size than the first evaporator 6, the second evaporator 9 requires a lower refrigerant flow rate, and therefore, a less expensive diaphragm means can be used. Especially, in the case where a solenoid valve is used for on/off operation of the second evaporator 9, the diaphragm means can be integrated with the solenoid valve and therefore the number of joins can also be reduced.

Even in the case where the thermal load of the second evaporator 9 is so small that the liquid refrigerant flows out of the outlet thereof, the evaporation of the liquid refrigerant through the first evaporator 6 prevents the blowout air temperature of the first evaporator 6 from being inconveniently increased.

Figure 2:
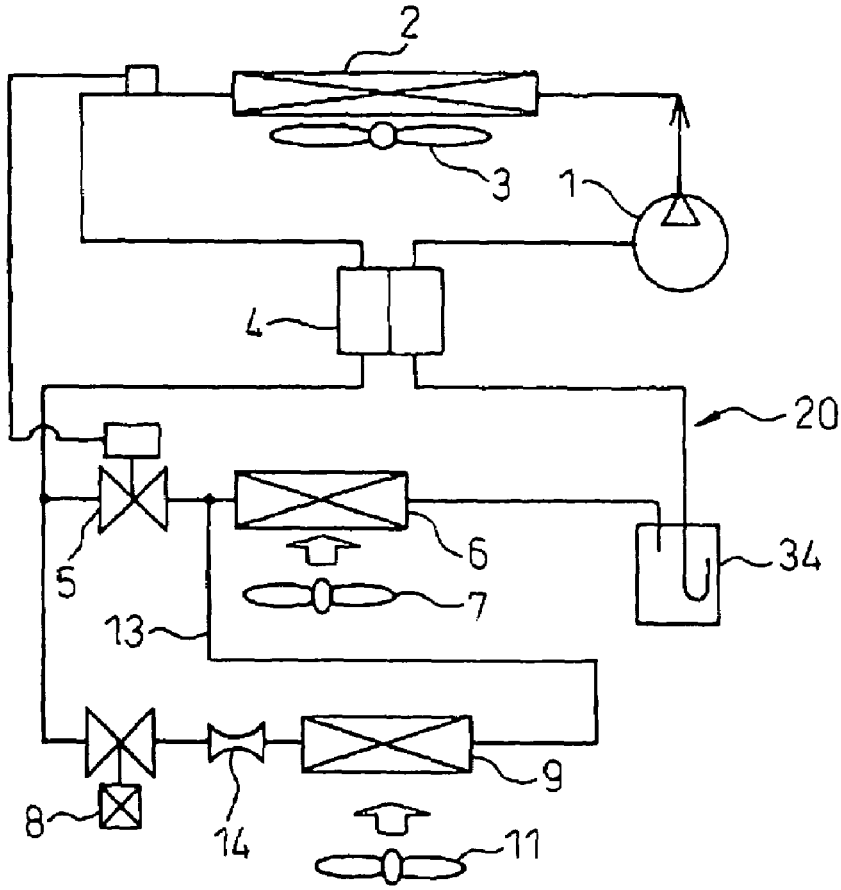
FIG. 2 is a schematic diagram showing a configuration of a refrigeration cycle system according to a second embodiment of the invention.

In the configuration and the refrigerant flow shown in FIG. 2, the component elements identical or similar to those in FIG. 1 are designated by the same reference numerals, respectively, as those in FIG. 1 and will not be explained.

As described above, with the refrigeration cycle system according to this embodiment, the refrigerant flowing out of the second evaporator 9 flows into the first evaporator 6, and the second decompressor is configured as a a fixed diaphragm unit 14 or a differential pressure valve with the opening area thereof variable under the pressure before and after the diaphragm mechanism. With this configuration, such a trouble as hunting in the high-pressure control operation with the superheat control operation of the refrigerant at the outlet of the evaporator is prevented, thereby improving the operation efficiency of the refrigeration cycle.

Third Embodiment

A third embodiment is explained with reference to FIGS. 3 and 4. A refrigeration cycle system 30 according to this embodiment is different from the refrigeration cycle system 10 according to the first embodiment in that an electrical expansion valve 19 is employed as a second decompressor. The refrigeration cycle system 30 includes a refrigerant temperature sensor 17 for detecting the temperature of the refrigerant upstream of the inlet of the second evaporator 9, a refrigerant temperature sensor 18 for detecting the refrigerant temperature downstream of the outlet of the second evaporator 9, and blowout air temperature sensors 15, 16 for detecting the temperature of the blowout air passed through the first evaporator 6 and the second evaporator 9, respectively. The blowout air temperature sensors 15, 16 are arranged in an air-conditioning unit case (not shown) nearer to the compartments than the evaporator to detect the temperature of the air-conditioning air cooled by the first evaporator 6 and the second evaporator 9 and flowing into the compartments. The resultant detection information, together with the detection information from the refrigerant temperature sensors 17, 18, is sent to the ECU 80 constituting a control means.

The opening degree of the electrical expansion valve 19 can be controlled to an arbitrary value including the closed-up state based on the information detected by the refrigerant temperature sensors 17, 18 and the blowout air temperature sensors 15, 16. Therefore, the refrigerant flow rate can be controlled over a wide range and the flow path can be closed. Also, the provision of the electrical expansion valve 19 can eliminate the need of the solenoid valve 12 of the first embodiment.

Figure 3:
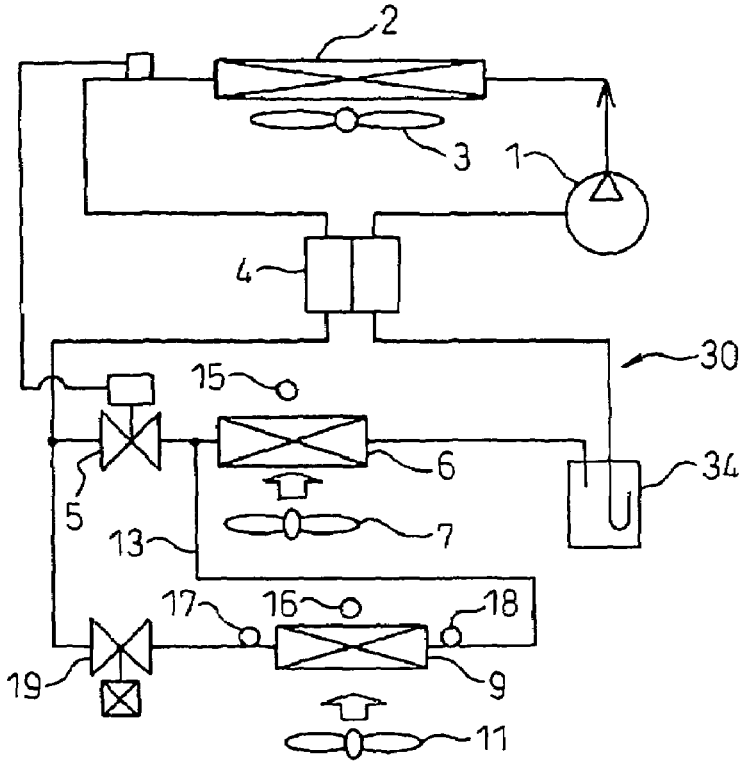
FIG. 3 is a schematic diagram showing a configuration of a refrigeration cycle system according to a third embodiment of the invention.

In the configuration of FIG. 3, the same reference numerals as those in FIG. 1 designate the same component elements, respectively, as in the first embodiment and will not be explained.

Next, the control operation of the electrical expansion valve 19 of the refrigeration cycle system 30 according to this embodiment is explained with reference to FIGS. 5, 6. The control methods shown in FIGS. 5, 6 are implemented by the ECU 80 constituting a control means.

Figure 5:
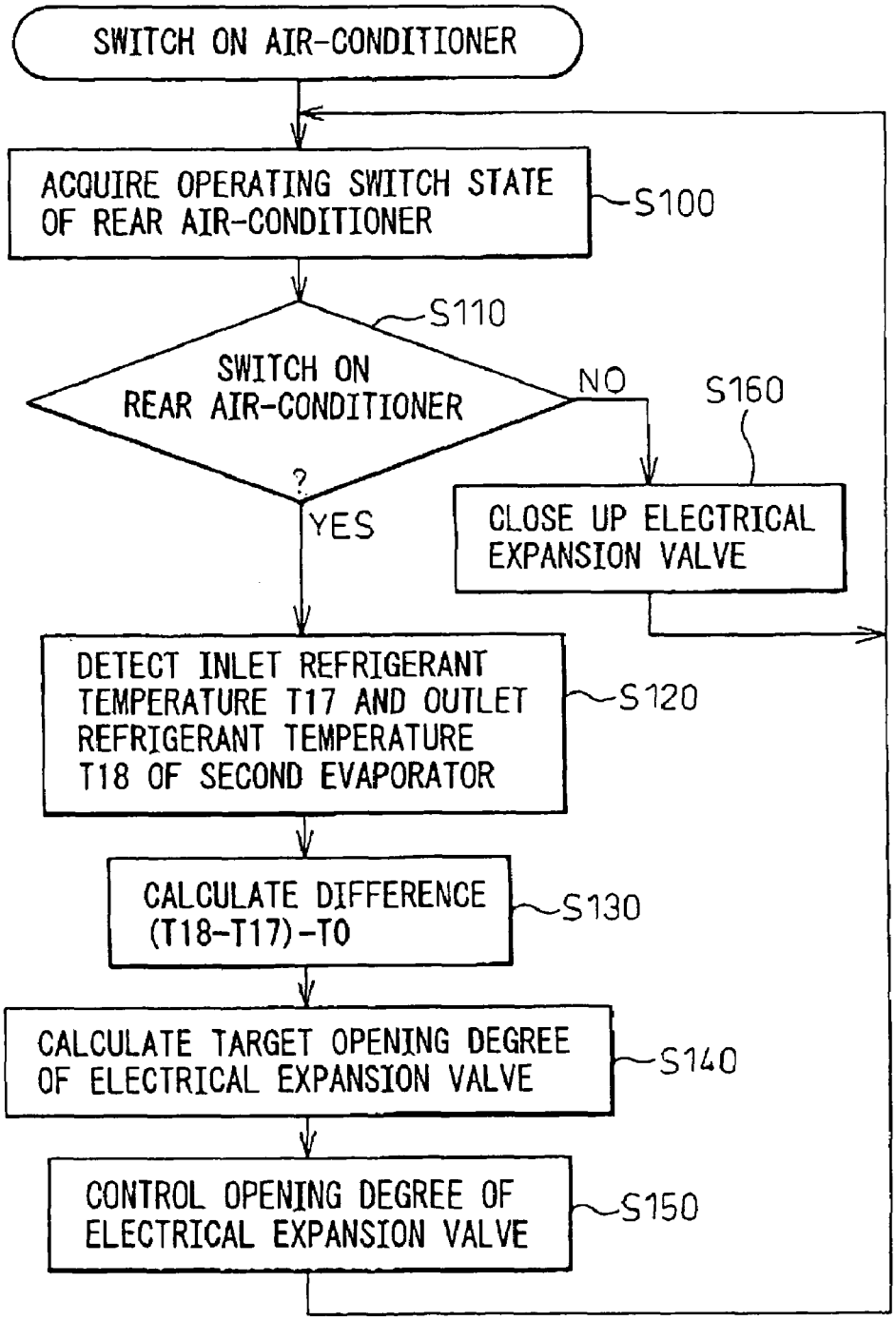
FIG. 5 is a flowchart showing the operation of the refrigeration cycle according to the third embodiment to make the determination using the difference in refrigerant temperature between the first evaporator and the second evaporator.
Figure 6:
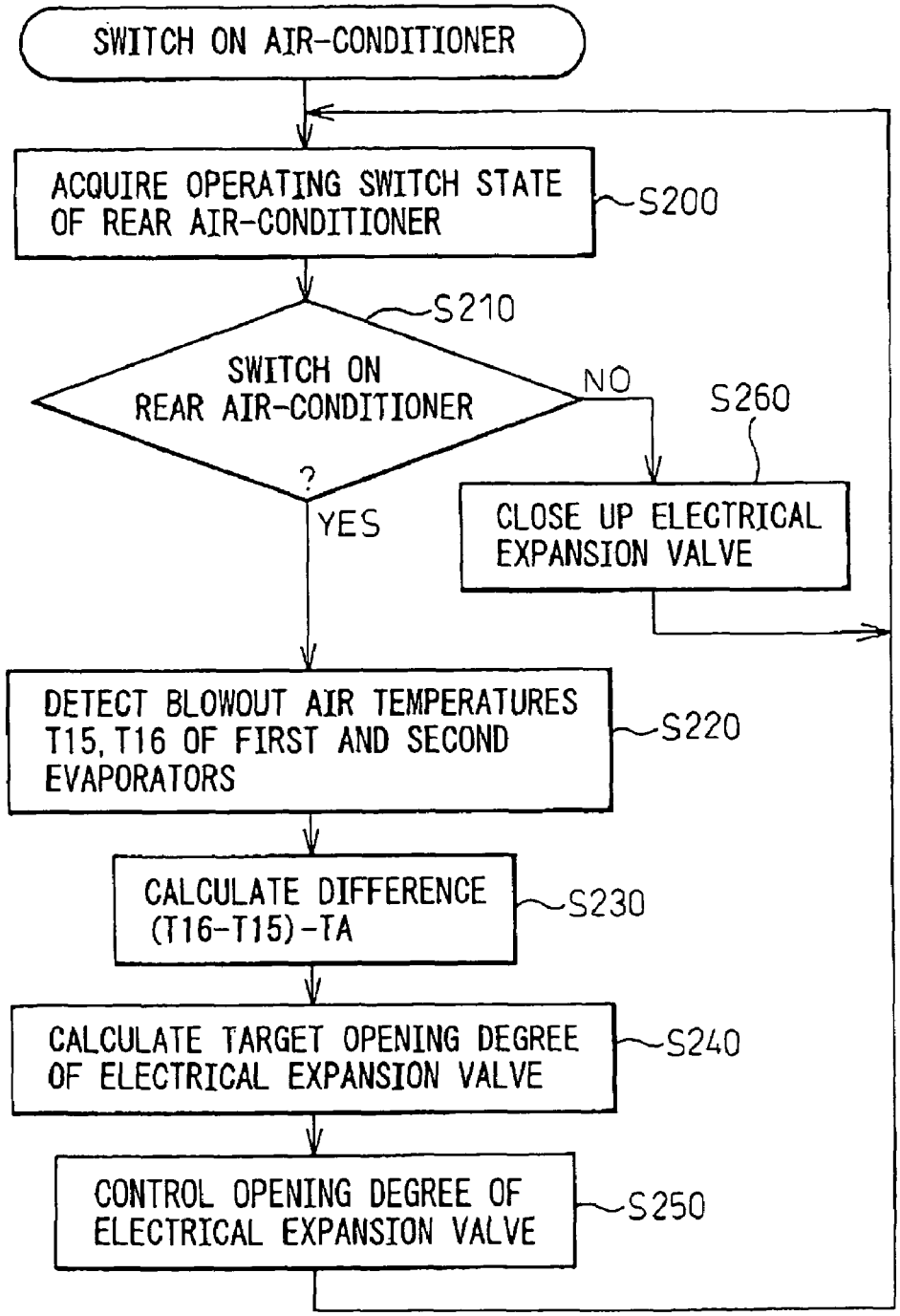
FIG. 6 is a flowchart showing the operation of the refrigeration cycle system according to the third embodiment to make the determination using the difference between the temperatures of the blowout air passing through the first evaporator and the second evaporator.

The flowchart of FIG. 5 shows the process including the steps of detecting the refrigerant temperature before and after the second evaporator 9, controlling the opening degree including the closed-up state of the electrical expansion valve 19 based on the detection information on the refrigerant temperature and controlling the superheat amount at the outlet of the second evaporator 9.

First, this control method starts with the on state of the air-conditioning switch. Next, the state of the operating switch of the second evaporator 9, i.e. the state of the operating switch of the rear air-conditioner is detected (step S100). Upon this detection, the state of the operating switch of the second evaporator 9 (rear air-conditioner) is determined (step S110). In the case where the state of this operating switch is on, the refrigerant temperature T17 upstream of the second evaporator 9 and the refrigerant temperature T18 downstream of the second evaporator 9 are detected by the refrigerant temperature sensors 17 and 18, respectively (step S120). In the case where the operating switch of the rear air-conditioner is off, on the other hand, the process jumps to step S160 and the electrical expansion valve 19 is closed. This process is repeated until the operating switch of the rear air-conditioner turns on.

The difference (T18−T17)−T0 between the temperatures T17 and T18 detected in step S120 is calculated using a predetermined value TO (step S130). The difference value this calculated is compared with a table, prepared in advance, and, in accordance with the comparison result, the target opening degree of the electrical expansion valve 19 is calculated (step S140). The opening degree of the electrical expansion valve 19 is controlled to achieve the calculated target opening degree (step S150) thereby to control the amount of the refrigerant flowing into the second evaporator 9. The process is then returned again to step S100, and the flow rate of the refrigerant flowing in the second evaporator 9 continues to be controlled.

The flowchart of FIG. 6 described below shows the process including the steps of detecting the temperature T15 of the blowout air passing through the first evaporator 6 and the temperature T16 of the blowout air passing through the second evaporator 9 and controlling the opening degree including the closed-up state of the electrical expansion valve 19 based on the temperature detection information.

This control method also starts with the on state of the air-conditioning switch. Then, the state of the operating switch of the second evaporator 9, i.e. the state of the operating switch of the rear air-conditioner is detected (step S200). With this detection, the state of the operating switch of the second evaporator 9 (rear air-conditioner) is determined (step S210), and in the case where the state of the particular switch is on, the temperature T15 of the blowout air passing through the first evaporator 6 and the temperature T16 of the blowout air passing through the second evaporator 9 are detected by the blowout air temperature sensors 15, 16, respectively (step S220). In the case where the state of the operating switch of the rear air-conditioner is off, on the other hand, the process jumps to step S260, in which the electrical expansion valve 19 is closed and the process is repeated until the operating switch of the rear air-conditioner turns on.

The difference (T16−T15)−TA between the temperatures T15 and T16 detected in step S220 is calculated using a predetermined value TA (step S230). The difference value thus calculated is compared with a table prepared in advance, and in accordance with the comparison result, the target opening degree of the electrical expansion valve 19 is calculated (step S240). The opening degree of the electrical expansion valve 19 is controlled to achieve the calculated target opening degree (step S250) thereby to control the amount of the refrigerant flowing into the second evaporator 9. The process is then returned again to step S200, and the flow rate of the refrigerant flowing to the second evaporator 9 continues to be controlled.

The control methods shown in FIGS. 5, 6 can be implemented also in the refrigeration cycle systems 10, according to the first and second embodiments and the refrigeration cycle systems 40, 50, 60, 70 according to the fourth to seventh embodiments described later by the provision of the refrigerant temperature sensors 17, 18 or the blowout air temperature sensors 15, 16.

As described above, the refrigeration cycle system according to this embodiment is so configured that the refrigerant flowing out of the second evaporator 9 flows into the first evaporator 6 and the electrical expansion valve 19 is employed as a second decompressor. This configuration makes it possible to turn on/off the refrigerant flowing into the second evaporator 9 using the electrical expansion valve alone without any on/off solenoid valve, while at the same time making it possible to control the refrigerant flow rate over a wide range.

The opening degree of the electrical expansion valve 19 is controlled based on the information on the refrigerant temperature before and after the second evaporator 9. The use of this control method can control the refrigerant flow rate with a high response.

Fourth Embodiment

Figure 7:
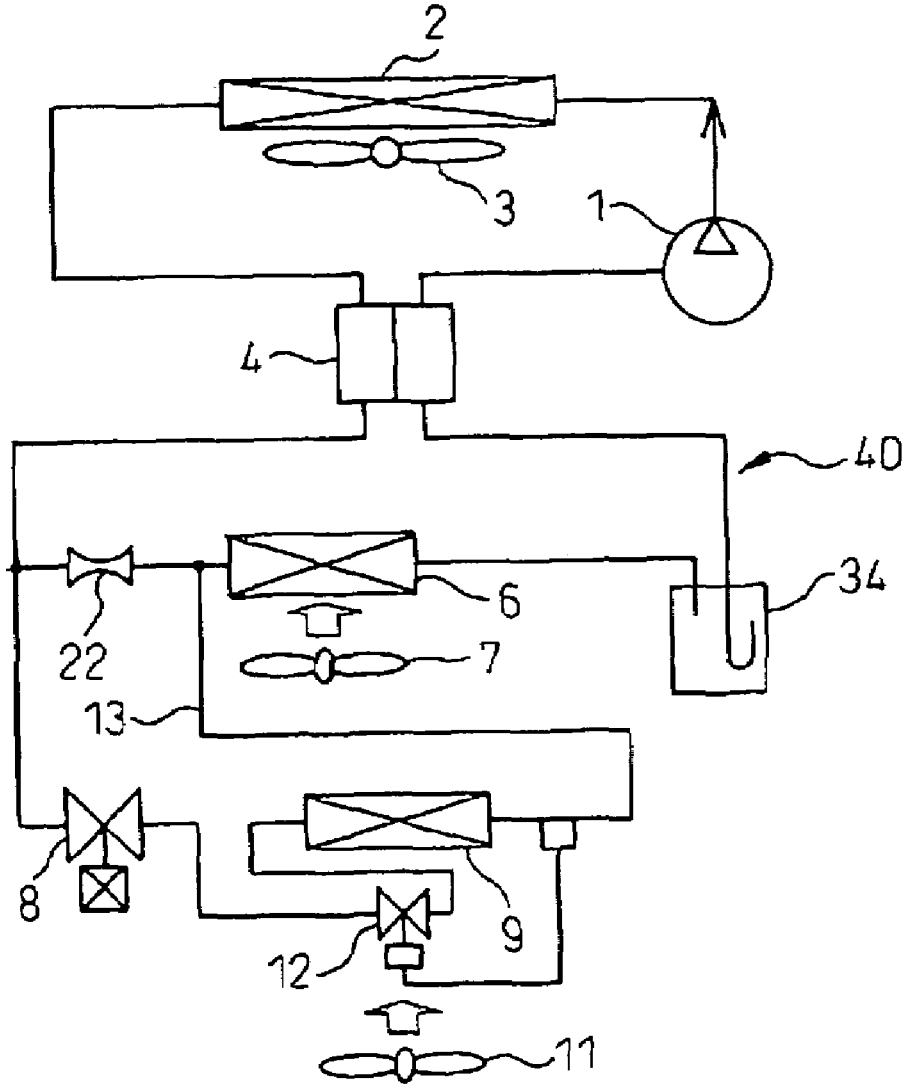
FIG. 7 is a schematic diagram showing a configuration of a refrigeration-cycle system according to a fourth embodiment of the invention.

A fourth embodiment is explained with reference to FIG. 7. The refrigeration cycle system 40 according to this embodiment described below is different from the refrigeration cycle system 10 of the first embodiment in that a diaphragm means such as an orifice or the like fixed diaphragm unit 22 or a differential pressure valve with the opening area thereof variable under the pressure before and after the diaphragm mechanism is employed as a first decompressor. Although the refrigeration cycle system 40 employs the superheat control valve 12 as a second decompressor, a fixed diaphragm unit or an electrical expansion valve may alternatively be employed. With regard to the configuration and the refrigerant flow shown in FIG. 7, the same reference numerals designate the same component elements, respectively, as those of the first embodiment and not explained below any further.

As described above, the refrigeration cycle system 40 according to this embodiment includes, as a first decompressor, a fixed diaphragm unit 22 constituting a diaphragm means or a differential pressure valve with the opening area thereof variable by the pressure before and after the diaphragm mechanism. Especially in the case where the compressor 1 is an external variable replacement refrigerant compressor, the high pressure can be controlled by changing the capacity of the compressor, and therefore, the system can be configured even with a fixed diaphragm unit having a narrow flow rate control range, in a more simplified structure and at a lower cost, than the high-pressure control valve.

Fifth Embodiment

A fifth embodiment is explained with reference to FIG. 8. A refrigeration cycle system 50 according to this embodiment comprises a compressor 1 for sucking in and compressing the refrigerant, a radiator 2 for radiating the heat of the high-pressure refrigerant discharged from the compressor 1, a plurality of refrigerant paths for distributing the high-pressure refrigerant flowing out of the radiator 2, a first evaporator 6 and a second evaporator 9 for evaporating the distributed high-pressure refrigerants, respectively, and an accumulator 34 for separating the inflowing refrigerant into a gas-phase refrigerant and a liquid-phase refrigerant and supplying the gas-phase refrigerant to the compressor 1. The plurality of the refrigerant paths include at least a bypass 28 through which the distributed high-pressure refrigerant is decompressed by the high-pressure control valve 23 and flows into the accumulator 34, a first distribution path 29 and a second distribution path 31 for distributing the high-pressure refrigerant into the first evaporator 6 and the second evaporator 9. Further, the system includes superheat control valves 25, 2-7 for controlling the superheat amount of at least one of the refrigerant at the outlet of the first evaporator 6 and the refrigerant at the outlet of the second evaporator 9. Furthermore, a solenoid valve 24 is arranged upstream of the first evaporator 6 in the first distribution path 29, and a solenoid valve 26 upstream of the second evaporator 9 in the second distribution path 31.

The solenoid valve 24, under the control of the ECU 80, can be switched between the state in which the refrigerant distributed to the first distribution path 29 from the radiator 2 is prevented from flowing into the second evaporator 9 and the state in which it is allowed to flow into the first evaporator 6. The solenoid valve 24 has the function of turning on/off the operation of the first evaporator 6 for cooling the rear part of the compartments. By the switching operation of the air-conditioning operation unit 21 by the user, the solenoid valve 24 is opened and the refrigerant is supplied to the first evaporator 6 in the case where the front air-conditioner is on, while the refrigerant flow to the first evaporator 6 is blocked by closing the solenoid valve 24 in the case where the front air-conditioner is off.

Similarly, the solenoid valve 26, under the control of the ECU 80, is switched between the state in which the refrigerant distributed to the first distribution path 31 from the radiator 2 is prevented from flowing into the second evaporator 9 and the state in which it is allowed to flow into the second evaporator 9. The solenoid valve 26 has the function of turning on/off the operation of cooling the rear part of the compartment. By the switching operation of the air-conditioning operation unit 21 by the user, the solenoid valve 26 is opened and the refrigerant is supplied to the second evaporator 9 in the case where the rear air-conditioner is on, while the refrigerant flow to the second evaporator 9 is blocked by the solenoid valve 26 closed in the case where the rear air-conditioner is off.

The solenoid valves 24, 26 are assumed to behave similarly. Specifically, the on/off timing of the respective solenoid valves 24, 26, i.e. the presence or absence of the refrigerant flow occur at the same timing, and can be controlled in such a manner as to eliminate the refrigerant flow rate difference between the first evaporator 6 and the second evaporator 9.

Figure 8:
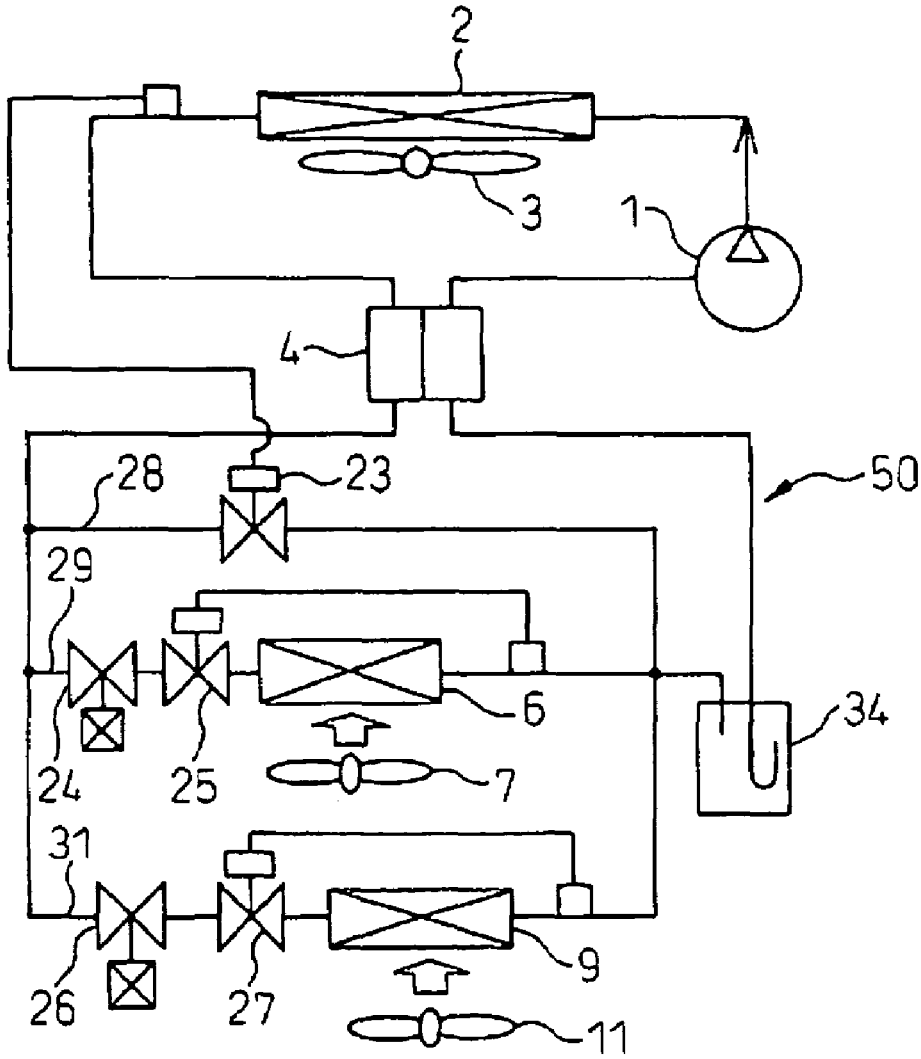
FIG. 8 is a schematic diagram showing a configuration of a refrigeration cycle system according to a fifth embodiment of the invention.

The component elements shown in FIG. 8 are similar to those of the first embodiment of FIG. 1 are designated by the same reference numerals, respectively, and will not be described.

A refrigeration cycle system 50 according to this embodiment comprises a compressor 1, a radiator 2 for radiating the heat of the high-pressure refrigerant discharged from the compressor 1, a plurality of refrigerant paths for distributing the high-pressure refrigerant flowing out of the radiator 2, a first evaporator 6 and a second evaporator 9 for evaporating the distributed high-pressure refrigerants, respectively, and an accumulator 34 for separating the influent refrigerant into a gas-phase refrigerant and a liquid-phase refrigerant and supplying the gas-phase refrigerant to the compressor 1. The plurality of the refrigerant paths include at least a bypass 28 through which the distributed high-pressure refrigerant is decompressed and flows into the accumulator 34, a first distribution path 29 and a second distribution path 31 for distributing the high-pressure refrigerant into the first evaporator 6 and the second evaporator 9, respectively. Further, the system includes superheat control valves 25, 27 for controlling the superheat amount of at least one of the refrigerant at the outlet of the first evaporator 6 and the refrigerant at the outlet of the second evaporator 9. With this configuration, the configuration of the refrigerant paths is simplified and the refrigerant flowing in each evaporator can be appropriately controlled.

Also, the bypass 28 includes a high-pressure control valve 23 for maintaining a high pressure to maximize the coefficient of performance of the refrigeration cycle. This configuration can improve the operation efficiency of the refrigeration cycle.

Also, the refrigeration cycle system 50 includes the superheat control valve to control the superheat amount at the outlet of each evaporator. Even in the case where the opening degree of the superheat control valve temporarily increases to an excessive level due to the change in low pressure, therefore, the refrigerant flow rate increases in all the evaporators similarly, and therefore the trouble is prevented in which only the blowout air temperature of the first evaporator 6 increases.

Also, the distribution of the high-pressure refrigerant leads to the advantage that, like in the refrigeration cycle systems 10, 20, 30, 40, the heat loss is small, the pipe requiring the heat insulation is short and the refrigerant variation by the on/off operation of the evaporator is small.

Further, in the refrigeration cycle system 50, the high-pressure control valve 23 is connected to the bypass 28 and, therefore, the flow of the refrigeration cycle is never closed. As a result, the evaporators can be advantageously switched on/off in an arbitrary combination.

Sixth Embodiment

Figure 9:
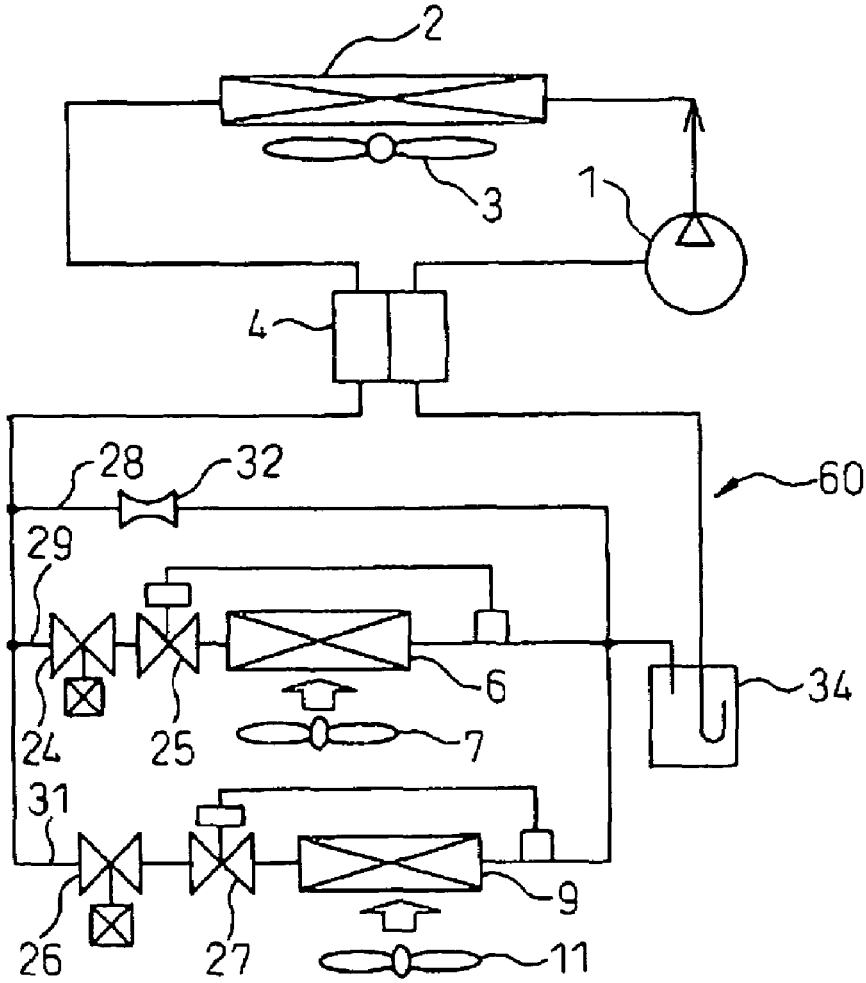
FIG. 9 is a schematic diagram showing a configuration of a refrigeration cycle system according to a sixth embodiment of the invention.

A sixth embodiment is explained with reference to FIG. 9. The refrigeration cycle system 60 according to this embodiment explained below is different from the refrigeration cycle system 50 according to the fifth embodiment in that a fixed diaphragm unit 32 constituting a diaphragm means such as an orifice or a differential pressure valve with the opening area thereof variable by the pressure before and after the diaphragm mechanism is employed as a high-pressure control valve of the bypass 28. In the configuration and the refrigerant flow shown in FIG. 9, the same or similar component elements as or to those in FIG. 1 or 8 are designated by the same reference numerals, respectively, as in the first embodiment and will not be described.

As described above, the refrigeration cycle system 60 according to this embodiment is so configured that the bypass 28 includes a fixed diaphragm unit 32 or a differential pressure valve with the opening area thereof variable by the pressure before and after the diaphragm mechanism. This configuration prevents a trouble such as hunting in the high-pressure control operation otherwise caused by the superheat control of the refrigerant at the outlet of the evaporator, thereby improving the operation efficiency of the refrigeration cycle.

Seventh Embodiment

Figure 10:
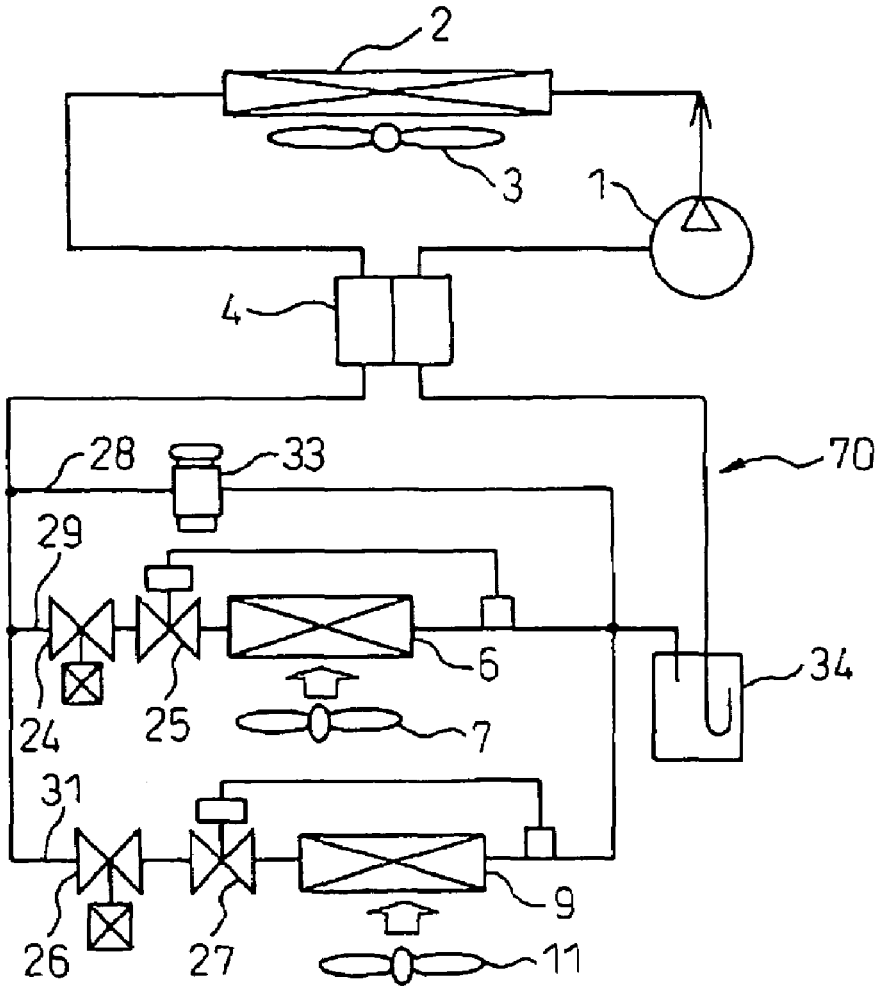
FIG. 10 is a schematic diagram showing a configuration of a refrigeration cycle system according to a seventh embodiment of the invention.
Figure 11A:
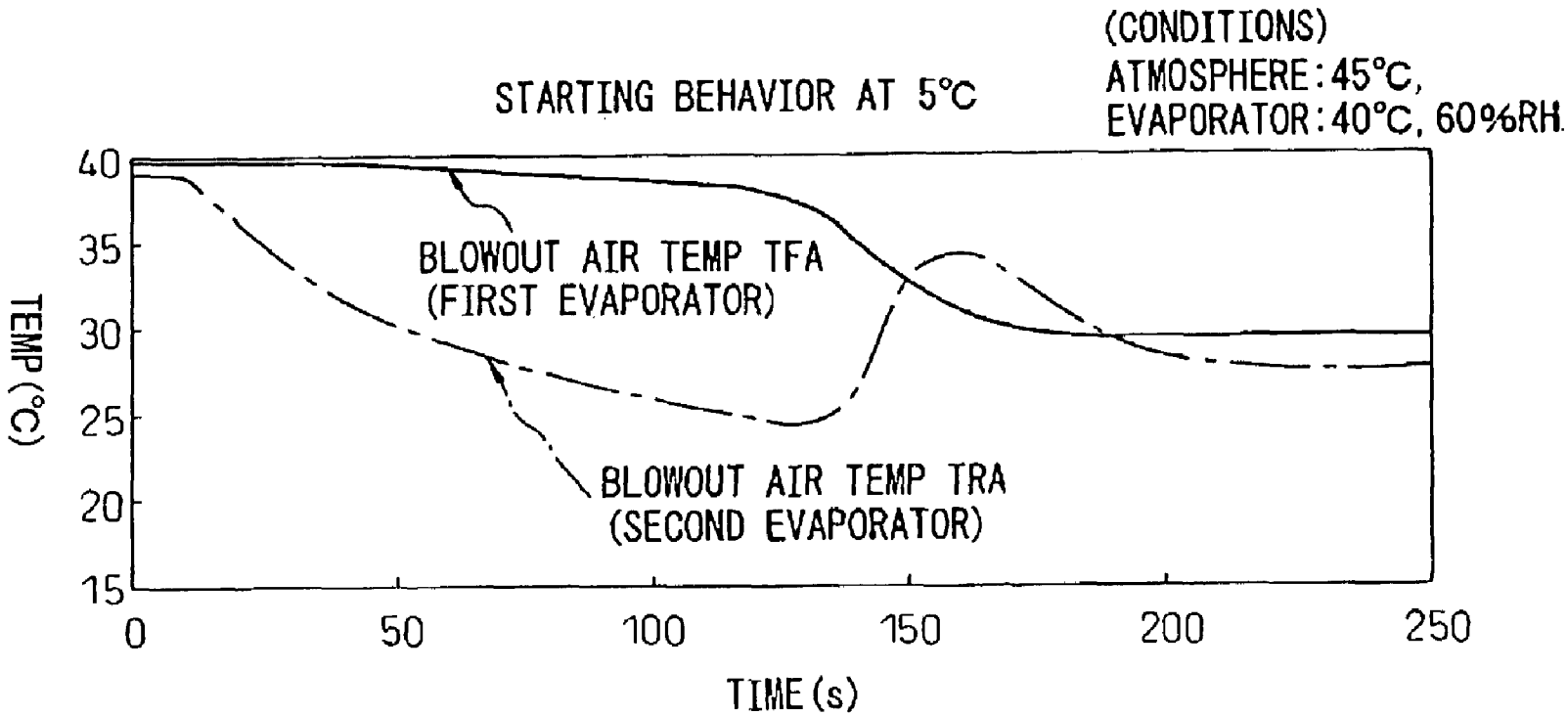
FIG. 11A is a graph showing the temperature behavior at the time of starting the system with the superheat control valve set to SH of 5° C. in the conventional refrigeration cycle system.
Figure 11B:
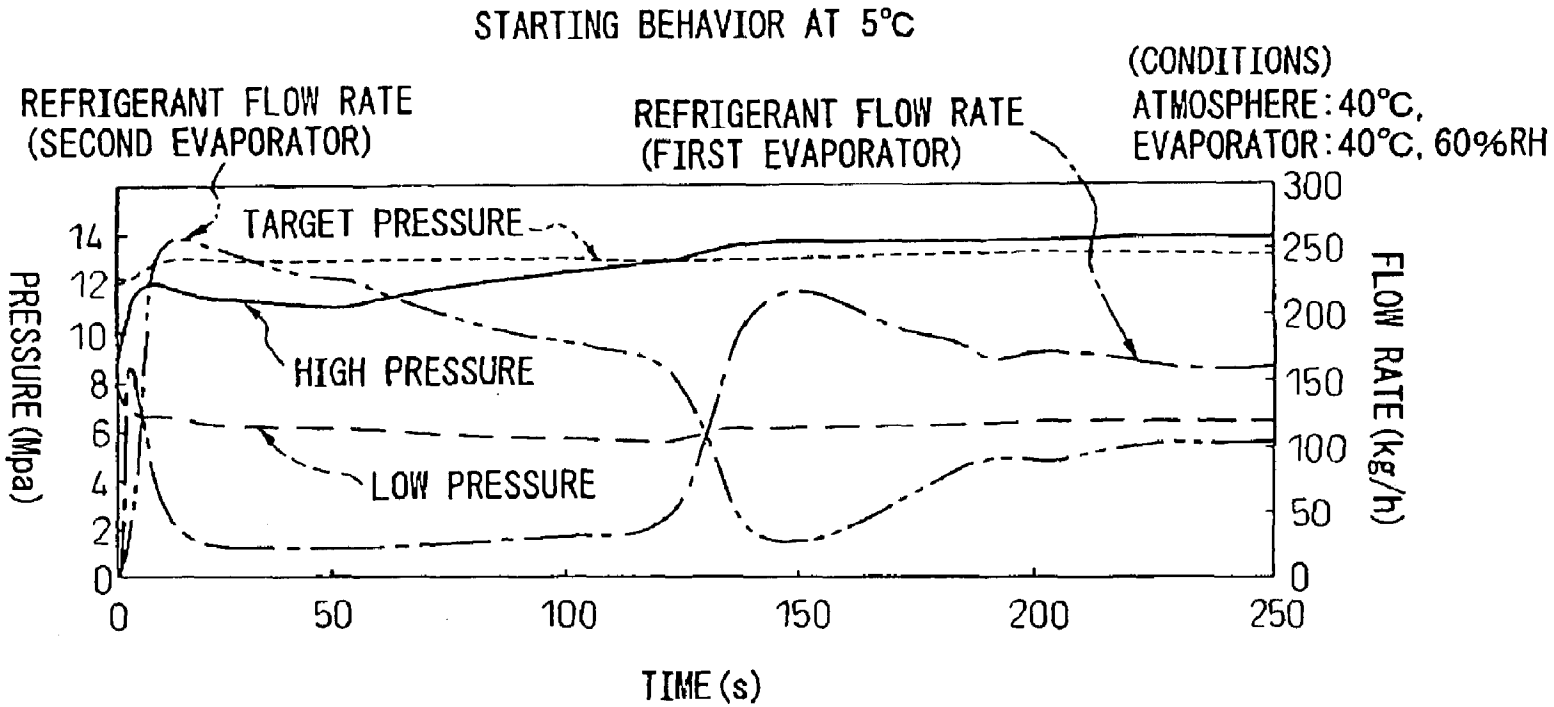
FIG. 11B is a graph showing the pressure behavior at the time of starting the system in the conventional refrigeration cycle system.

A seventh embodiment of the invention is explained with reference to FIG. 10. The refrigeration cycle system 70 according to this embodiment is different from the refrigeration cycle system 50 according to the fifth embodiment in that a high-pressure control valve 33 having a temperature sensor built therein is arranged in the bypass 28. In the configuration and the refrigerant flow shown in FIG. 10, the component elements similar or identical to those in FIG. 1 or 8 are designated by the same reference numerals, respectively, as in the fifth and first embodiments and will not be described.

The temperature sensor of the high-pressure control valve 33 detects the temperature at the outlet of the radiator 2 to perform the high pressure control operation. In view of some correlation between the outlet temperature of the radiator 2 and the outlet temperature of the internal heat exchanger 4, however, the high-pressure refrigerant can be controlled using the outlet temperature of the internal heat exchanger 4.

The refrigerant at the outlet of the internal heat exchanger 4 directly flows into the high-pressure control valve 33. In the case where the temperature of the refrigerant at the outlet of the internal heat exchanger is used for the control operation, therefore, the temperature sensor can be arranged in the high-pressure control valve 33 and therefore the step of mounting the temperature sensor can be eliminated.

As described above, in the refrigeration cycle system 70 according to this embodiment, the bypass 28 includes the high-pressure control valve 33 having a temperature sensor built therein which maintains a high pressure to maximize the coefficient of performance of the refrigeration cycle. This configuration improves the operation efficiency of the refrigeration cycle.

OTHER EMBODIMENTS

The embodiments described above refer to a refrigeration cycle using carbon dioxide as a refrigerant. Nevertheless, ethylene, ethane, nitrogen oxide or the like refrigerant, usable in a supercritical area, can be used in place of carbon dioxide.

Also, the embodiments described above are so configured that the air blown to the front part of the compartments is cooled by the first evaporator 6 and the air blown to the rear part of the compartments by the second evaporator 9. Conversely, however, the air blown to the front part of the compartments may be cooled by the second evaporator 9 and the air blown to the rear part of the compartments by the first evaporator 6.

Further, the high-pressure control operation of the high-pressure control valve 33 having the temperature sensor built therein according to the seventh embodiment may be implemented in combination with any other embodiments described above.

While the invention has been described by reference to specific embodiments chosen for purposes of illustration, it should be apparent that numerous modifications could be made thereto by those skilled in the art without departing from the basic concept and scope of the invention.

The invention claimed is:

1. A supercritical refrigeration cycle system of vapor compression type with pressure in the refrigeration cycle reaching and exceeding a critical pressure of a refrigerant, the supercritical refrigeration cycle system comprising:

a compressor for sucking in and compressing the refrigerant;

a radiator for radiating heat of the refrigerant discharged from the compressor;

a plurality of decompressors into which the refrigerant discharged from the radiator flows;

a first evaporator for evaporating refrigerant decompressed by the first decompressor; and a second evaporator for evaporating refrigerant decompressed by the second decompressor;

wherein the refrigerant flowing out of one of the first evaporator and the second evaporator flows into the other of the first evaporator and the second evaporator.

2. A supercritical refrigeration cycle system according to claim 1, wherein one of the plurality of the decompressors comprises a high-pressure control valve for maintaining a high pressure to maximize a coefficient of performance of the refrigeration cycle.

3. A supercritical refrigeration cycle system according to claim 1, wherein the refrigerant flowing out of the second evaporator flows into the first evaporator, and the second decompressor comprises a mechanical superheat control valve for controlling a superheat amount of the refrigerant at an outlet of the second evaporator.

4. A supercritical refrigeration cycle system according to claim 1, wherein the refrigerant flowing out of the second evaporator flows into the first evaporator, and the second decompressor comprises one of a fixed diaphragm unit and a differential pressure valve with an opening area thereof changeable by pressure before and after a diaphragm mechanism.

5. A supercritical refrigeration cycle system according to claim 1, wherein the refrigerant flowing out of the second evaporator flows into the first evaporator and the second decompressor Gonstitutes comprises an electrical expansion valve.

6. A supercritical refrigeration cycle system according to claim 5, wherein an opening degree of the electrical expansion valve is controlled based on temperature information of the refrigerant before and after the second evaporator.

7. A supercritical refrigeration cycle system of vapor compression type with pressure in the refrigeration cycle reaching and exceeding a critical pressure of a refrigerant, the supercritical refrigeration cycle system comprising:

a compressor for sucking in and compressing the refrigerant;

a radiator for radiating heat of the refrigerant discharged from the compressor;

a plurality of refrigerant paths for distributing refrigerant flowing out of the radiator;

a first evaporator and a second evaporator for evaporating the refrigerant distributed from the plurality of refrigerant paths; and an accumulator for separating inflowing refrigerant into a gas-phase refrigerant and a liquid-phase refrigerant and supplying the gas-phase refrigerant to come compressor, wherein the plurality of the refrigerant paths include a bypass allowing decompressed refrigerant to flow into the accumulator and a first distribution path and a second distribution path for distributing the refrigerant to the first evaporator and the second evaporator, respectively, the system further comprising a superheat control valve for controlling a superheat amount of at least one of the refrigerant at an outlet of the first evaporator and the refrigerant at an outlet of the second evaporator.

8. A supercritical refrigeration cycle system according to claim 7, wherein the bypass includes a high-pressure control valve for maintaining a high pressure to maximize a coefficient of performance of the refrigeration cycle.

9. A supercritical refrigeration cycle system according to claim 7, wherein the bypass includes one of a fixed diaphragm unit and a differential pressure valve having an opening area variable by a pressure before and after a fixed diaphragm mechanism.

* * * * *